United States Patent [19]

Ekemar et al.

[11] Patent Number: 5,032,174

[45] Date of Patent: Jul. 16, 1991

[54] POWDER PARTICLES FOR FINE-GRAINED HARD MATERIAL ALLOYS AND A PROCESS FOR THE PREPARATION OF POWDER PARTICLES FOR FINE-GRAINED HARD MATERIAL ALLOYS

[75] Inventors: Carl S. G. Ekemar, Saltsjö-Boo; Rolf G. Oskarsson, Rönninge, both of Sweden

[73] Assignee: Santrade Limited, Lucerne, Switzerland

[21] Appl. No.: 426,863

[22] Filed: Oct. 26, 1989

Related U.S. Application Data

[60] Division of Ser. No. 163,155, Feb. 25, 1988, Pat. No. 4,894,090, which is a continuation of Ser. No. 906,437, Sep. 12, 1986, abandoned.

[30] Foreign Application Priority Data

Sep. 12, 1985 [SE] Sweden ..... 8504167

[51] Int. Cl.[5] ..... C22C 1/00

[52] U.S. Cl. ..... 75/354; 75/352

[58] Field of Search ..... 75/0.5 B, 0.5 BA, 0.5 BB, 75/0.5 BC, 354, 352

[56] References Cited

U.S. PATENT DOCUMENTS

| | | | |
|---|---|---|---|
| 3,459,546 | 8/1969 | Lambert | 75/0.5 BC |
| 3,591,362 | 7/1971 | Benjamin | 75/255 |
| 3,650,729 | 3/1972 | Kindlimann et al. | 75/0.5 BC |
| 3,916,497 | 11/1975 | Doi et al. | 75/236 |
| 3,953,194 | 4/1976 | Hartline, III et al. | 75/0.5 BC |
| 4,192,672 | 3/1980 | Moskowitz et al. | 75/254 |
| 4,619,699 | 10/1986 | Luton | 75/252 |
| 4,687,511 | 8/1987 | Paliwal et al. | 75/0.5 BA |

FOREIGN PATENT DOCUMENTS

| | | | |
|---|---|---|---|
| 8301917 | 6/1983 | European Pat. Off. . | |
| 2033100 | 3/1971 | Fed. Rep. of Germany | 75/0.5 BB |
| 3011962 | 10/1981 | Fed. Rep. of Germany . | |
| 48-28247 | 8/1973 | Japan . | |
| 57-26101 | 2/1982 | Japan | 75/0.5 BA |
| 63-100108 | 5/1988 | Japan | 75/0.5 BA |
| 0647349 | 2/1979 | U.S.S.R. | 75/0.5 BB |

OTHER PUBLICATIONS

Bizhev et al., "Production of Nitrided Iron-Chromium-Manganese-. . . ", Metalurgiya (Sofia), 37(11), 1982, pp. 8-10.

*Primary Examiner*—R. Dean
*Assistant Examiner*—David W. Schumaker
*Attorney, Agent, or Firm*—Burns, Doane, Swecker & Mathis

[57] ABSTRACT

The present invention relates to powder particles consisting of hard principles and binder metal for the manufacture of superior, uniquely fine-grained hard material alloys and to a procedure for the preparation of said particles.

The preparation is performed in an economical way because the procedure starts from conventional melt metallurgical raw materials. A pre-alloy consisting of hard principle forming and binder phase forming elements is subjected to a heat treatment such as nitriding and carburizing after being crushed. The final product is particles composed by hard principle phases and binder metal phases formed "in situ" in an effective binding.

5 Claims, No Drawings

POWDER PARTICLES FOR FINE-GRAINED HARD MATERIAL ALLOYS AND A PROCESS FOR THE PREPARATION OF POWDER PARTICLES FOR FINE-GRAINED HARD MATERIAL ALLOYS

This application is a divisional, of U.S. application Ser. No. 07/163,155, filed Feb. 25, 1988, which is a continuation of U.S. Ser. No. 06/906,437, filed Sept. 12, 1986, now abandoned.

The present invention relates to a method of making powder particles for the manufacturing of superior, uniquely fine-grained hard material alloys.

"Hard material alloys" in this connection means alloys with a higher content of hard principles than that of high speed steel and with iron, cobalt and/or nickel as dominating element in the binder metal alloy. An important part of the actual alloys has a smaller content of hard principles than what conventional cemented carbides usually have.

The invention relates to the manufacture of said unique powder particles in the best technical and economical manner. The basis for the favorable economical preparation is that the procedure starts from conventional melt metallurgical raw materials. The end product is particles composed of hard principle phases and binder phases effectively bound.

Among alloys with higher contents of hard principles higher than those of high speed steel are the alloys having titanium carbide in a steel matrix. These alloys are made by using conventional cemented carbide technique in which both the hard principles—essentially titanium carbide—and the binder metal powder—essentially iron powder prepared, for example, as carbonyl iron powder or electrolytically made iron powder—are used as raw materials. Said conventional powder metallurgical raw materials are expensive. Sintering of pressed bodies is performed by so called melt phase sintering which means that the hard principle grain size will be considerably greater than 1 μm in the final alloy even when the titanium carbide in the ground powder had a grain size smaller than 1 μm. The final alloy usually has a volume of binder phase of about 50 per cent. In order to limit the carbide grain growth as far as possible and control the tolerances of the dimensions and forms of the sintered bodies, lowered sintering temperatures are used by utilizing low temperature eutectics connected with property limiting additions as, for example, some per cent of copper. Passivated surfaces on the titanium carbide grains prevent the wetting of the melt during the sintering and reduce the strength of the bonds between the carbide phase and the binder phase of the sintered material.

It is well known that sharp edges are very favorable for cutting tools when cutting steel and other metals. Thus, great efforts have been made all over the world to manufacture fine-grained hard material alloys because the finer the grain of the hard material alloy, the sharper the edge which can be obtained. A great number of solutions have been presented during the years.

One way of producing particles with fine-grained hard principles is by so-called rapid solidification in which a melt is disintegrated into small droplets which are solidified very rapidly. Cooling rates higher than $10^4$ K/s are usual. In this way great supersaturations, high nuclei densities and short diffusion distances are obtained which give a fine grain size. High contents of hard principles are difficult to obtain, however, because superheating of the melt is needed to avoid primary, coarse precipitations in the form of dendrites or other structural parts. The technically economical limit is about 20 per cent by volume of hard principles in a solidified alloy. A high content of hard principle forming elements also leads to problems such as stop up in nozzles, etc. Superheated melts are aggressive against and, thus, decrease strongly the life of linings in furnaces, ladles, nozzles etc. It is difficult to avoid slag-forming elements that lowers properties. Alloys produced by rapid solidification are very expensive.

"Mechanical alloying" is a method of making particles of very fine-grained grains by intensive high energy milling of essentially metallic powder raw materials. The method starts from expensive raw materials. In the preparation of the hard material not only the binder phase formers but also the carbide formers are added as metal powders. The elements of the groups IVA and VA are particularly reactive and have a great affinity to carbon, nitrogen, boron and particularly oxygen. "Mechanical alloying" for preparation of alloys with great amounts of said elements make high demands on safe equipments and rigorously formed precautionary measures in the accomplishment of the processes. Therefore in the manufacture of, among others, dispersion hardened superalloys with aluminium oxide and other hard principles, finished hard principles are added to the batches which are to be milled. The contents of hard principles are limited to contents not being above those of the high speed steels. This is particularly valid for hard principles of the metals of the groups IVA and VA as the dominating hard principle-forming metals. The method is very expensive since it is limited to small milling charges because dry milling uses a high input of energy, the main part of the generated heat has to be cooled away, and the high wear of mills, milling bodies, etc. To obtain particles of finely distributed, ductile, metallic grains extensive cold working has to be done. However, cold working results in coarse carbide grains, which lower the properties, frequently forming in the otherwise fine-grained structures because of the reactions in the subsequent carburizing and sintering steps.

Other methods, known for a long time, of making fine-grained, hard principle-rich powders are to prepare oxide mixtures, which are reduced and then carburized and/or nitrided. Small batches and a careful procedure as well as the resulting high costs are inevitable. One example is the preparation of submicron cemented carbide. Such cemented carbide can be produced for example by first reducing and then carburizing cobalt tungstate or by a reduction and selective carburization of oxide mixtures such as $WO_3+Co_3O_4$. Hard principle grains with oxygen on their surfaces are difficult to wet with melts based on metals of the iron group. Remaining films or grains of oxides or oxygen-enrichments of other kinds lower the strength of the bonds of sintered materials. Oxygen which is reduced by carbon—a generally used element in hard materials—disappears, for example, in the form of carbon monoxide, CO. Said carbon monoxide has a negative influence on the elimination of pores in the sintering and also makes the maintenance of the precise carbon content control in finished alloys more difficult. The more fine-grained a hard principle is, the more sensitive it is to surface oxidation Submicron titanium carbide can be prepared in oxygen-free form by chemical gas deposition by means of high temperature plasma. Only under such conditions that oxygen from the air or other gaseous oxygen can be kept away all through the procedure, can a dense hard material with effective binging between the hard principle phases and binder metal phases be made. A condition is that the hard principle grains are activated by intensive milling to make sintering possible. Submicron powder is extremely voluminous and from that follows great difficulties to handle, mill and press in a rational way. When intensively milled, submicron powder in pressed bodies is sintered, it is necessary to give up the fully satisfactory properties of a sintered material in order to restrain a dangerous grain growth.

The present invention relates to an economic method of preparing powders of particles composed of metallic binder phases in direct binding to fine-grained hard particles starting from cheap melt metallurgical raw materials Hard principle formers in hard materials are essentially the elements of the groups IVA, VA and VIA of the periodical system and silicon. Grains and particles of the hard principles of said elements—carbides, nitrides, borides, carbonitrides, oxycarbides, etc—are very sensitive to surface oxidation in air or other oxygen containing gases and gas mixtures In particular, the elements of the groups IVA, VA and Si form oxides, which demand strong reduction means such as carbon in order to remove or decrease surfacebound oxygen.

The invention relates to a method of making particles composed of binder metal alloys in an effective binding with fine-grained hard principles. The volume fraction of hard principles in the particles has to be within the range of 25–90 per cent by volume, preferably 30–80 per cent by volume and especially 35–70 per cent by volume. The hard principles are formed of elements of the groups IVA, VA and VIA of the periodical system and/or silicon. Ti, Zr, Hf, V, Nb, Ta and/or silicon have to be ≧55 atomic per cent, preferably ≧60 atomic per cent of the hard principle-forming metals in the hard principles. Remaining hard principle-forming metals in the hard principles are Cr, Mo and/or W. The hard principles are compounds between said metals and C, N and/or B. In the hard principles of the particles, the elements C, N and/or B can be replaced by oxygen up to 20 atomic per cent and preferably up to 10 atomic per cent of the amount of C, N and/or B without impairing the properties of the particles. The grain sizes of the particles and of the hard principles of the particles determine the usability of the particles in the manufacturing of powder metallurgical hard material alloys whether performed by powder forging, powder rolling and/or powder extrusion or by sintering of pressed bodies with or without the presence of a melted phase. The mean size of the particles has to be within the range of 1–16 μm, preferably 2–8 μm, at which at the most 5% and preferably at the most 2% of the number of particles has a particle size >30 μm. The hard principles consist of grains having a mean grain size within the range of 0.02–0.80 μm, preferably 0.3–0.60 μm, at which at the most 5% and preferably at the most 2% of the number of grains is >1.5 μm. The binder metal alloys, which are based upon Fe, Co and/or Ni, can have various alloying elements in solution and consist of one or more structure elements usually present in alloys based upon Fe, Co and/or Ni. The fraction of hard principle forming elements of the above-mentioned hard principles, which can be in the binder metal alloy, is ≦30 atomic per cent, preferably ≦25 atomic per cent. Such elements as Mn, Al and Cu can be ≦15, ≦10 and ≦1 atomic per cent, respectively, and preferably ≦12, ≦8 and ≦0,8 atomic per cent, respectively.

Particles according to the invention can be manufactured by various combinations of raw materials and procedures.

The procedure which gives the best product, starts from melt metallurgical raw materials. Such raw materials can be prepared at low cost compared to conventional high purity powder metallurgical raw materials. The preparation of the particles starts with the melting and casting of raw materials containing the metallic alloying elements of the hard principle forming as well as the binder metal forming elements—but without intentional additions of the elements C, N, B and/or O—to form pre-alloys. Melting is preferably performed in protective gas or vacuum furnaces, for example arc furnaces with consumable electrodes, arc furnaces with permanent electrodes and cooled crucibles, electron beam furnaces or crucible furnaces with inductive heating. It is essential that the melt before casting is performed within a temperature range of 50°–300° C., preferably 100°–250° C., above the liquidus temperature of the actual pre-alloy. The melting procedure, gas atmosphere and slag bath can be used for the cleaning of the melt from dissolved and undissolved impurities. The melt is transformed into a solid pre-alloy by casting of conventional ingots or by atomizing in vacuum or alternatively in a suitable cooling medium such as argon.

Because the pre-alloys contain metallic elements in proportions according to the prevent invention, the elements of the solidified material will to a great extent consist of brittle phases. Phases, which are important and present in great amounts, are intermetallic phases such as so called "Laves"- and "Sigma"-phases. (Reference NBS special Publication 564, May 1980, U.S. Government Printing Office, Washington, DC 20402, USA). It is characteristic of the actual intermetallic phases that the hard principle forming and binder metal forming metallic elements are effectively mixed in atomic scale. Crushing and milling transform the pre-alloys to powder, aggregations of grains and particles, characterized by a size distribution according to the invention. The dominating presence of brittle phases facilitates crushing and milling and strongly restrains the cold working of particles and grains, i.e., deformation of the crystal lattices.

The milling is preferably performed in a protected environment, for example in benzene, perchlorethylene etc. The milled pre-alloy is subjected to carburizing, carbonitriding, nitriding, boronizing etc. It can preferably be done by compounds such as $CH_4$, $C_2H_6$, CN, HCN, $NH_3$, $N_2H_6$, $BCl_3$ etc.

The pre-alloys can contain all the metallic elements of the final material. This makes a simultaneous formation of final hard principles and binder phase alloys possible at a low temperature and in an intimate contact with each other. By this measure unique and superior properties of the hard material alloys are obtained. The temperature range of a simultaneous formation "in situ" of hard principle grains and binder metal elements in effective binding from the pre-alloy elements is 200°–1200° C., preferably 300°–1000° C. The treatment is performed at atmospheric pressure or at low pressure depending upon the type of furnace.

The preparation of powder particles according to the invention and essential characteristics of such particles or products will be more evident from the following Example.

EXAMPLE

A pre-alloy was prepared in a vacuum furnace by melting with a rotating water-cooled tungsten electrode. The casting was also performed in vacuum. The composition of the final pre-alloy in per cent by weight was 54% Fe, 26.5% Ti, 8% Co, 4.5% W, 3.5% MO, 3% Cr, 0.3% Mn, 0.2% Si.

The pre-alloy was first crushed in a jaw crusher and then in a cone mill to a grain size between 0,2 and 5 mm.

The pre-alloy was very easy to crush because of its dominating content of brittle Laves-phase. 10 kg of the crushed pre-alloy was charged into a mill having an interior volume of 30 l and containing 120 kg cemented carbide balls as milling bodies. Perchlorethylene was used as milling liquid. 0.05 kg carbon in the form of graphite powder was also added.

After milling for 10 hours the particles had got a mean grain size of 4 μm. The milled mixture was charged on trays protected from the oxygen from the air by the milling liquid.

The charged trays were placed in a furnace and hot nitrogen gas with a temperature of 100°-120° C. flowed through the furnace and over the trays. The milling liquid was evaporated and a dry powder bed was obtained after eight hours. The last residues of the milling liquid were removed by pumping vacuum in the furnace The temperature in the furnace was increased under maintained vacuum and at 300° C. nitrogen gas was carefully led into the furnace up to a pressure of 150 torr. Between 300° and 400° C., the nitriding process started, which could be observed as a decrease of pressure in contrast to the increase of pressure, which had earlier been obtained at increasing temperature. The temperature was raised to 800° C. during 5 hours. The consumption of nitrogen gas was kept under control the whole time, so that the exothermic process should not go out of control. The pressure was kept between 150 and 300 torr and argon was added to dilute the nitrogen content of the furnace atmosphere and in this way to control the rate of the nitriding. The procedure was maintained at 800° C. for 4 hours and a pressure of about 300 torr. The addition of argon during the nitriding process was carried out with a slow increase of the amount of argon up to 75 per cent by volume of the furnace atmosphere. Finally the temperature was raised to 1000° C. (over about 30 minutes time) and the temperature was maintained constant for five minutes, after which the furnace was cooled down in vacuum. The furnace was opened when the charge had got a temperature well below 100° C.

The obtained powder had, in per cent by weight, a nitrogen content of 7.3% and a carbon content of 0.6% (the increased carbon content coming from cracking of the remaining milling liquid residues after evaporation). The hard principle content of the powder was about 50 per cent by volume, essentially consisting of titanium nitride and with small amounts of (Ti, Fe, Cr, Mo, W, Co)-carbonitrides in a steel matrix. The mean grain size of the hard principles was determined to about 0.1 μm.

After disintegrating and screening the powder was pressed cold-isostatically at a pressure of 180 MPa to extrusion billets ϕ70 mm, which then were placed in steel cans ϕ76 mm and a wall thickness of 3 mm, which were evacuated and sealed. The cans were heated to 1150°-1175° C. for 1 hour, after which they were extruded in an extrusion press with a billet cylinder ϕ80 mm to bar ϕ24 mm.

The mean grain size of the titanium nitride in the material, prepared as above, was measured to 0.1-0.2 μm. The bonds between hard principles and binder phase were complete.

We claim:

1. Method of making powder particles of a mean particle size between 1 and 16 μm with at most 5% of the particles having a particle size > 30 μm for the preparation of a fine-grained hard material alloy for cutting tools consisting essentially of hard principles in an amount of 25-90 volume % and binder metal with the alloy containing greater contents of hard principles than in high speed steel, in which the hard principles are compounds of one or more elements in the groups IVA, VA and VIA of the periodical system and Si with C, N and/or B, and the binder metal being based upon Fe, Co and/or Ni, characterized in that melt metallurgical raw materials containing the metallic alloying elements for both the hard principle forming and the binder metal forming elements, but without intentional additions of the elements C, N, B and O, are melted and cast to a pre-alloy, which in solidified condition consists essentially of brittle, intermetallic phases with hard principle forming and binder metal forming elements mixed in atomic scale, after which the pre-alloy is crushed and/or milled to powder and the powder is subjected to treatment for the simultaneous in situ formation of hard principles grains and binder metal constituents.

2. Method according to claim 1, characterized in that the preparation of the melt before the casting is performed within a temperature range of 50°-300° C. above the liquidus temperature of the pre-alloy.

3. Method according to claim 1, characterized in that the treatment for the simultaneous in situ formation of hard principle grains and binder metal elements is conducted at a temperature of from about 200°-1200° C.

4. Method according to claim 2, characterized in that the casting is performed at a temperature in a range within 100°-250° C. above the liquidus temperature of the pre-alloy.

5. Method according to claim 3, characterized in that the temperature range for treatment is about 300°-1000° C.

* * * * *